US005971905A

United States Patent [19]

Fukuda

[11] Patent Number: 5,971,905

[45] Date of Patent: Oct. 26, 1999

[54] BAG MAKER-PACKAGING MACHINE CAPABLE OF AUTOMATICALLY POSITIONING ITS COMPONENTS

[75] Inventor: Masao Fukuda, Shiga, Japan

[73] Assignee: Ishida Co., Ltd., Kyoto, Japan

[21] Appl. No.: 08/926,173

[22] Filed: Sep. 9, 1997

[30] Foreign Application Priority Data

Sep. 26, 1996 [JP] Japan ..... 8-275550

[51] Int. Cl.[6] ..... B31B 1/00; B65B 9/06

[52] U.S. Cl. ..... 493/3; 493/25; 493/29; 493/34; 493/35; 53/551; 53/51

[58] Field of Search ..... 493/3, 9, 10, 13, 493/14, 17, 25, 29, 30, 24, 34, 35, 302; 53/551, 201, 51, 66

[56] References Cited

U.S. PATENT DOCUMENTS

| | | | |
|---|---|---|---|
| 4,514,819 | 4/1985 | Punater et al. | 493/35 |
| 4,766,716 | 8/1988 | Dominguez | 53/551 |
| 5,000,725 | 3/1991 | Bauknecht | 493/29 |
| 5,203,760 | 4/1993 | Chen et al. | 493/302 |
| 5,242,364 | 9/1993 | Lehmann | 493/34 |
| 5,295,942 | 3/1994 | Franklin | 493/302 |
| 5,505,037 | 4/1996 | Terminella et al. | 53/552 |
| 5,524,413 | 6/1996 | Fukuda et al. | 53/64 |
| 5,537,798 | 7/1996 | Fukuda et al. | 53/201 |
| 5,715,656 | 2/1998 | Pearce | 53/201 |

FOREIGN PATENT DOCUMENTS

| | | | |
|---|---|---|---|
| 6-32325 | 6/1994 | Japan | 53/55 |

*Primary Examiner*—Peter Vo
*Assistant Examiner*—A. Dexter Tugbang
*Attorney, Agent, or Firm*—Majestic, Parsons, Siebert & Hsue P.C.

[57] ABSTRACT

A bag maker-packaging machine adapted for use with formers having different sizes uses pull-down belts to pull by suction an elongated film which has been tubularly formed by a former. When a new former is installed, the pull-down belts are moved from specified belt reference positions towards the surface of the film in a tubular form, and the distance travelled by them until they come into contact with the film surface is measured. After the size of the former is thus identified, positions of some of the components such as a guide roller and a turn bar for the transportation of film to the former are adjusted accordingly. Data corresponding to different former sizes may be stored in a memory and compared with the identified size of the former currently installed. The user can see on a display device what kinds of product can be packaged by using this identified former and may also be informed if the memory does not store any data for formers of the identified size.

16 Claims, 2 Drawing Sheets

BAG MAKER-PACKAGING MACHINE CAPABLE OF AUTOMATICALLY POSITIONING ITS COMPONENTS

BACKGROUND OF THE INVENTION

This invention relates to a bag maker-packaging machine of the type adapted to form bags continuously from an elongated web of a bag-forming material.

Requirements by consumers are becoming complex. For potato chips, for example, not only different flavors such as salted, cheese-flavored, onion-flavored and vinegar-flavored kinds must be made available, but different kinds with different strengths of flavoring are also required. From the point of view of the manufacturer, this means that bag-forming materials with different designs and/or measurements must be used for different kinds of products, and that formers of different shapes and sizes must be used to form bags from these materials. As a result, handling and management of these bag-forming materials and formers become even more complicated and cumbersome.

When products of different kinds look alike such as potato chips which are flavored differently, there is an increased probability of committing an error of using a wrong kind of bag-forming material to package a given kind of products. When the sizes of different formers are nearly alike such as 5 inches and 5¼ inches, there is also an increased probability of committing an error of installing a wrong former and ending up by producing a large quantity of defective products.

Depending on the differences in the size of the former and the manner of effecting the longitudinal sealing of the bag-forming material, furthermore, it is necessary to displace the bag-forming material in the transverse direction. When the packaging machine is prepared for products specified according to a given production schedule, product codes corresponding to the specified product kinds must be looked up in an item list, but inexperienced operators are likely to waste time in the search for specified entries and to commit input errors.

In view of the problems described above, the present inventor disclosed in Japanese Patent Publication Tokkai 6-32325 an apparatus capable of automatically selecting an appropriate former and bag-forming material in response to inputted data on a specified product and adapted to adjust the position of the bag-forming material in the transverse direction by displacing a turn bar or its position relative to the selected former by moving a guide roller in a forward-backward direction.

This apparatus is advantageous in that a former and a bag-forming material can be automatically selected on the basis of inputted data. When new products are to be packaged with this apparatus, however, new data corresponding to them must be inputted each time.

SUMMARY OF THE INVENTION

It is therefore an object of this invention in view of the above to provide an improved bag maker-packaging machine capable of automatically positioning adjustable components such as the guide roller and the turn bar on the basis of the size of each newly installed former.

It is another object of this invention to provide such an improved bag maker-packaging machine adapted to display, whenever a new former is installed, what kinds of packaging can be carried out by using this former and optimum conditions for packaging a selected kind of products.

It is still another object of this invention to provide such an improved bag maker-packaging machine adapted to check whether or not the former which has been installed thereon is a proper one for carrying out the intended kind of packaging such that production of defective products can be prevented.

A bag maker-packaging machine embodying this invention, with which the above and other objects can be accomplished, is of the kind which uses suction-providing pull-down belts to transport an elongated bag-forming material, tubularly formed by the former, in the direction of the transverse sealer and may be characterized as comprising belt-displacing means for moving the pull-down belts from their specified reference positions to the surface of the bag-forming material, measuring means for measuring the distance by which the pull-down belts are displaced and identifying means for identifying, on the basis of the measured value, the size of the former which has been installed and serving to move its adjustable components such as the guide roller and the turn bar according to the identified size of the former which has been installed. On the basis of this identified size, a menu may be displayed on a display means to show the kinds of product which may be packaged by using this former. If the user selects one of the displayed kinds of packaging, optimum conditions for carrying out the packaging operation may be displayed. If the identified size does not match any of the data already stored, the user is informed of it on the display means.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
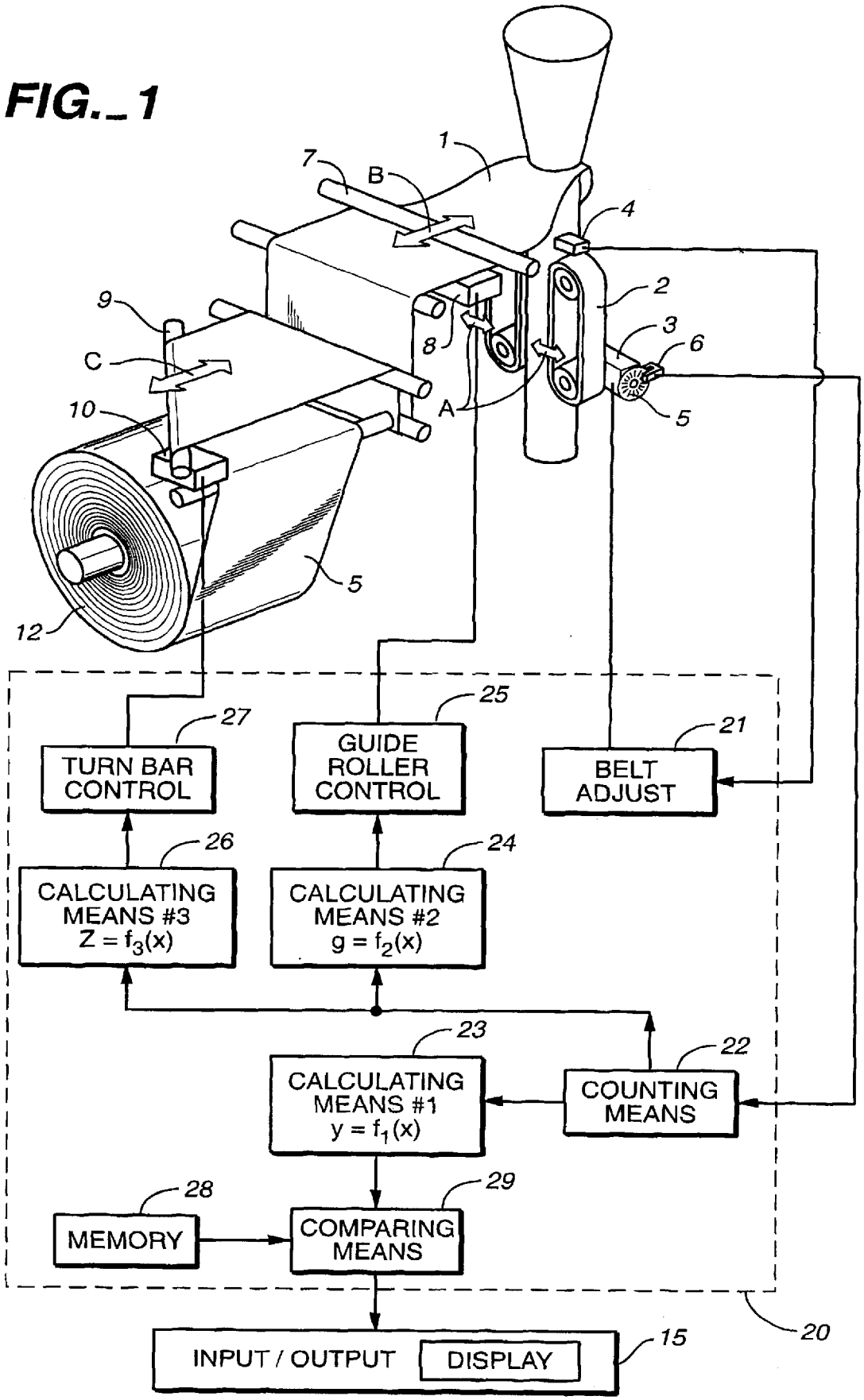
FIG. 1 is a schematic diagonal view of a portion of a bag maker-packaging machine embodying this invention and a block diagram of its control unit.

The invention is described next by way of a bag maker-packaging machine of the so-called vertical pillow type shown in FIG. 1. When a former 1 and a film roll 12 are selected and installed on the machine appropriately, pull-down belts 2 are moved from their reference positions separate from the tubularly formed bag-forming material (herein referred to as "the film") S towards the former 1 as shown by arrows A by means of a belt-driving motor 3 in response to an output signal from a control unit 20 until they come into contact with the bag-forming material S. In the meantime, a guide roller 7 adjacent the former 1 is displaced in the direction of arrow B by means of a roller-driving motor 8 in response to another signal outputted from the control unit 20, that is, in the longitudinal direction in which the film S is transported to the former 1, and a 45-degree turn bar 9 is shifted by means of a turn bar-driving motor 10 in response to still another signal outputted from the control unit 20 so as to displace the film S in its transverse direction indicated by arrow C according to the size of the film S and the manner of the longitudinal sealing to be effected. In FIG. 1, numeral 4 indicates a proximity switch such as a supersonic sensor for detecting the contact of either one of the pull-down belts 2 with the film S or its approach (within a predefined sense) to the film S, and numeral 6 indicates a pulse generator for outputting a pulse indicative of the number of rotation of the belt-driving motor 3 through a rotary encoder 5.

The control unit 20 is for the control of all these devices, comprising, as schematically shown in FIG. 1, a belt control means 21, a counting means 22, first, second and third calculating means 23, 24 and 26, a guide roller control means 25, a turn bar control means 27, a memory means 28 and a comparing means 29. The belt control means 21 is for activating the belt-driving motor 3 by means of a motor-starting switch (not shown) and to control it, stopping it in response to a detection signal outputted from the proximity switch 4. The counting means 22 is for counting the pulse signals from the pulse generator 6, and the first calculating means 23 is for calculating the distance y travelled by the pull-down belts 2 from their reference positions on the basis of the number x counted by the counting means 22 as $y=f_1(x)$. The second calculating means 24 is for calculating the distance g travelled by the guide roller 7 from its reference position on the basis of the counted number x as $g=f_2(x)$, and the guide roller control means 25 is for controlling the roller-driving motor 8 on the basis of this calculated value. The third calculating means 26 is for calculating the distance z travelled by the turn bar 9 from its reference position on the basis of the counted number x as $z=f_3(x)$, and the turn bar control means 27 is for controlling the turn bar-driving motor 10 on the basis of this calculated value. On the basis of the size of the former 1 thus determined, the comparing means 29 serves to retrieve relevant data from the memory means 28 such as the kinds of product that may be packaged by using this former 1 and to display such retrieved data on a display device indicated in FIG. 1 as a part of an input-output means 15. The user may use this input-output means 15 to select one of the displayed kinds of product, thereby causing the kind of film S to be used and the conditions for effecting the sealing to be displayed on the display means.

Figure 2:
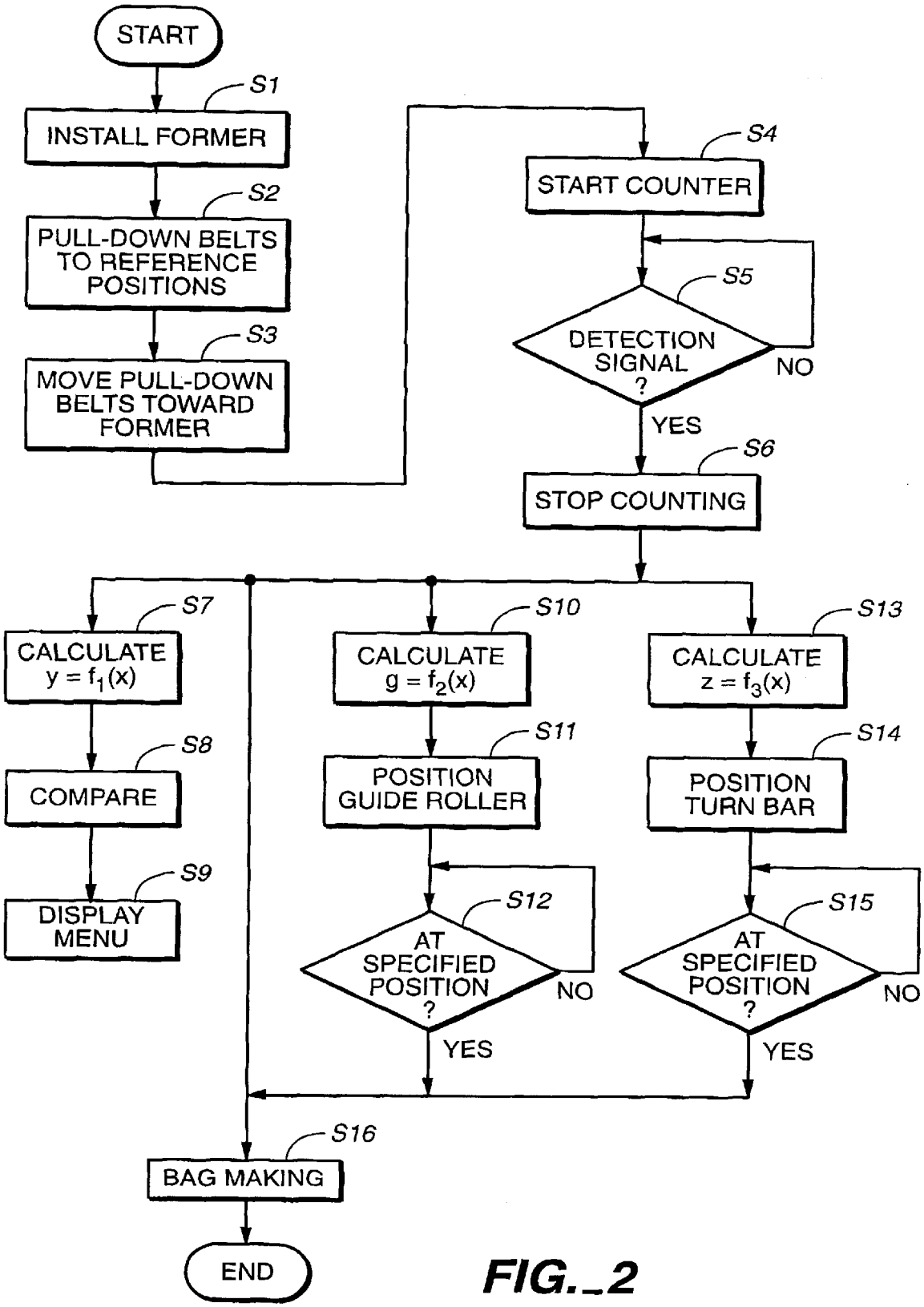
FIG. 2 is a flow chart of the operation of the control unit of the bag maker-packaging machine of FIG. 1.

The operations of this packaging machine, thus structured as described above, will be explained next with reference to the flow chart shown in FIG. 2.

Let us assume that the production of a specified number of products of a specified kind has just been completed according to a production plan and that a new former 1 has thereafter been installed for packaging products of another kind (Step S1). If a start button (not shown in FIG. 1) is pressed, the belt control means 21 responds by activating the belt-driving motor 3 to return the pull-down belts 2 first to their reference positions (Step S2) and then towards the newly installed former 1 (Step S3). In the meantime, the number x of pulses from the pulse generator 6 is counted by the counting means 22 as the distance travelled by the pull-down belts 2 from their reference positions (Step S4). When the pull-down belts 2 come into contact with or within a predefined very small distance of the surface of the now tubularly formed film S and this condition is detected by the proximity switch 4, a detection signal emitted therefrom is received by the belt control means 21 (YES in Step S5), and the pull-down belts 2 are set at the current positions. As the belt-driving motor 3 is stopped, the counting of the pulse signals is also stopped (Step S6), and the counted number x of pulses is transmitted to the first calculating means 23. The first calculating means 23 calculates the radius R of the former 1 as $R=L_0-L$ and the width B of the bag produced by the longitudinal sealing as $B=2\pi R=2\pi(L_0-L)$ (Step S7) where $L_0$ is the distance between the center of the former 1 and the reference positions of the pull-down belts 2 and L is the distance travelled by each pull-down belt 2 (=y). The calculated value $y=f_1(x)$ is transmitted to the comparing means 29 and compared thereby (Step S8) with various data which have been stored in the memory means 28 corresponding to formers with different sizes. Data such as the kinds of product which may be packaged by using this former 1 are displayed as a menu and, when the user specifies one of the displayed items through the input/output means 15, package-making conditions such as the sealing condition corresponding to the selected kind of product to be packaged are displayed. The comparing means 29 further serves to check whether the size of the former 1 currently installed on the machine matches the specified former size and to display the result of the checking (Step S9).

The counted number x of pulses is also outputted to the second and third calculating means 24 and 26 whereby the positions of the guide roller 7 and the 45-degree turn bar 9 from their respective reference positions are obtained as $g=f_2(x)$ and $z=f_3(x)$ (Steps S10 and S13). The positions of the guide roller 7 and the 45-degree turn bar 9 are adjusted according to these calculated values g and z (Steps S11 and S14). After these positioning operations are completed, (YES in Steps S12 and S15), bag making-packaging operations are started (Step S16).

The invention has been described above by way of only one example, but this example is not intended to limit the scope of the invention. Many modifications and variations are possible within the scope of this invention. Although a control routine has been illustrated whereby calculations for the positioning of the guide roller 7 and the 45-degree turn bar 9 are carried out every time the counted pulse number x has been ascertained, these positions and other data for menu displays may be stored each time so as to provide a learning function to the system. The positioning of the pull-down belts 2 against the film surface may be effected manually. Although the use of a rotary encoder and a pulse generator (shown respectively at 5 and 6 above) was disclosed as means for measuring the distance travelled by the pull-down belts, neither is this intended to limit the scope of the invention. Examples of other kind of such a distance-measuring means include range finders using ultrasonic waves and those using a linear type encoder.

As described above, the positioning of the guide roller and the turn bar can be effected automatically according to this invention on the basis of the distance travelled by the pull-down belts from their specified reference positions to the surface of the former surface. Thus, the time required for preparing the bag maker-packaging machine for its operations can be significantly shortened and the probability of committing errors can be reliably reduced. With the memory means storing data on the kinds of product that can be packaged by using each of the available formers with different sizes, the user can correctly match a former of a right kind for each kind of products to be packaged. Whenever a new former is installed, furthermore, its size can be measured quickly by counting the number of pulses as the pull-down belts are moved from their reference positions to the contact positions. If the measured size matches with any of the sizes stored in the memory means, adjustable components such as the guide roller and the turn bar can be positioned automatically according to the stored data. If the measured size does not match, on the other hand, the user can be informed of the fact through the display means and the probability of erroneously using a wrong former can be significantly reduced.

What is claimed is:

1. A bag maker-packaging machine for use with installed formers having different sizes, said bag maker-packaging machine comprising:

a former for forming an elongated film into a shape of a tubular formed film having a longitudinal axis;

pull-down belts for pulling said tubular formed film;

belt-adjusting means for moving said pull-down belts from predetermined reference belt positions separate from said tubular formed film towards an inward direction substantially perpendicular to said longitudinal axis of said tubular formed film;

measuring means for measuring the distance travelled by said pull-down belts along the inward direction by said belt-adjusting means; and identifying means for identifying the size of said former from results measured by said measuring means.

2. The bag maker-packaging machine of claim 1 further comprising:

position-adjustable components of which the positions with respect to said former can be adjusted; and control means for adjusting positions of said position-adjustable components according to the size identified by said identifying means.

3. The bag maker-packaging machine of claim 2 further comprising detecting means for outputting a detection signal when said pull-down belts come into a contacting relationship with said tubularly formed film, said identifying means identifying the size of said former from the result of measurement by said measuring means when said detection signal is received.

4. The bag maker-packaging machine of claim 1 further comprising:

position-adjustable components of which the positions with respect to said former can be adjusted;

display means for causing a menu displayed corresponding to the former size identified by said identifying means; and input means for allowing a user to input therethrough a packaging condition selected from said displayed menu.

5. The bag maker-packaging machine of claim 4 further comprising detecting means for outputting a detection signal when said pull-down belts come into a contacting relationship with said tubularly formed film, said identifying means identifying the size of said former from the result of measurement by said measuring means when said detection signal is received.

6. The bag maker-packaging machine of claim 1 further comprising:

position-adjustable components of which the positions with respect to said former can be adjusted; and comparing means for comparing the size identified by said identifying means and a preselected former size, causing positions of position-adjustable components to be adjusted if said identified size by said identifying means and said preselected former size agree, and causing a disagreement displayed on a display device if said identified size by said identifying means and said preselected former size disagree.

7. The bag maker-packaging machine of claim 1 further comprising detecting means for outputting a detection signal when said pull-down belts come into a contacting relationship with said tubularly formed film, said identifying means identifying the size of said former from the result of measurement by said measuring means when said detection signal is received.

8. The bag maker-packaging machine of claim 1 wherein said measuring means includes a rotary encoder, a pulse generator for outputting pulse signals indicative of a number of rotations of a motor for driving said pull-down belts through said rotary encoder, and a counting means for counting said pulse signals from said pulse generator.

9. A method of operating a bag maker-packaging machine which includes pull-down belts for pulling down a tubularly formed elongated film; said method comprising the steps of:

installing one of a plurality of different formers;

forming an elongated film into a shape of a tubular formed film having a longitudinal axis;

causing said pull-down belts to move from predetermined reference belt positions separate from said tubular formed film toward an inward direction substantially perpendicular to said longitudinal axis of said tubular formed film to come into contact with said tubularly formed film;

measuring a distance travelled by said pull-down belts along the inward direction to come into contact with said tubularly formed film from said reference belt positions; and identifying the size of said installed former from said measured travelled distance.

10. The method of claim 9 further comprising the step of initially moving said pull-down belts to said reference belt positions.

11. The method of claim 9 wherein said former includes position-adjustable components of which the positions with respect to said installed former are adjustable, said method further comprising the step of adjusting positions of said position-adjusting components according to the identified size of said installed former.

12. The method of claim 11 further comprising the step of initially moving said pull-down belts to said reference belt positions.

13. The method of claim 9 further comprising the steps of causing a menu of packaging conditions displayed corresponding to the size of said installed former, and selecting one of said displayed packaging conditions from said menu for the operation of said bag maker-packaging machine.

14. The method of claim 13 further comprising the step of initially moving said pull-down belts to said reference belt positions.

15. The method of claim 9 wherein said former includes position-adjustable components of which the positions with respect to said installed former are adjustable, said method further comprising the steps of comparing the identified size of said installed former with a preselected former size, adjusting the positions of said position-adjustable components if said identified size and said preselected former size agree, and causing a disagreement displayed on a display device if said identified size and said preselected former size disagree.

16. The method of claim 15 further comprising the step of initially moving said pull-down belts to said reference belt positions.

* * * * *